US009327300B2

(12) United States Patent
Chen et al.

(10) Patent No.: US 9,327,300 B2
(45) Date of Patent: May 3, 2016

(54) SPRAY GUN WITH SIDE-MOUNTED FAN CONTROL

(71) Applicant: FUJI INDUSTRIAL SPRAY EQUIPMENT LTD., Toronto (CA)

(72) Inventors: Jui-Chuan Chen, Taichung (TW); Mark Rosin, Thornhill (CA); Paul Michael Smith, Toronto (CA)

(73) Assignee: FUJI INDUSTRIAL SPRAY EQUIPMENT LTD., Toronto, ON (CA)

( * ) Notice: Subject to any disclaimer, the term of this patent is extended or adjusted under 35 U.S.C. 154(b) by 102 days.

(21) Appl. No.: 14/024,375

(22) Filed: Sep. 11, 2013

(65) Prior Publication Data

US 2015/0069147 A1 Mar. 12, 2015

(51) Int. Cl.

| | |
|---|---|
| ***B05B 7/00*** | (2006.01) |
| ***B05B 7/24*** | (2006.01) |
| ***B05B 7/08*** | (2006.01) |

(52) U.S. Cl.

CPC ..... *B05B 7/0081* (2013.01); *B05B 7/0815* (2013.01); *B05B 7/2491* (2013.01)

(58) Field of Classification Search

CPC .... B05B 7/0081; B05B 7/2413; B05B 7/241; B05B 7/2432; B05B 7/2429; B05B 7/2478; B05B 7/2483; B05B 7/2491; B05B 7/0815; B05B 7/12; B05B 7/1209

USPC ..... 239/296, 300, 373, 375, 396, 407, 443, 239/436, 525, 526, 581.1, 290, 301, 318, 239/340, 346, 364, 365

See application file for complete search history.

(56) References Cited

U.S. PATENT DOCUMENTS

| | | | | | |
|---|---|---|---|---|---|
| 4,154,403 | A * | 5/1979 | Forrester | 239/528 | |
| 5,064,119 | A * | 11/1991 | Mellette | 239/8 | |
| 5,152,460 | A * | 10/1992 | Barty | 239/290 | |
| 5,803,367 | A * | 9/1998 | Heard et al. | 239/296 | |
| 5,911,365 | A * | 6/1999 | Huang | 239/300 | |
| 6,708,900 | B1 * | 3/2004 | Zhu et al. | 239/296 | |
| D497,661 | S | 10/2004 | Chen | | |
| 7,097,118 | B1 * | 8/2006 | Huang | B05B 1/3013 | 239/290 |
| 2010/0224700 | A1 * | 9/2010 | Woodgate et al. | 239/344 | |

OTHER PUBLICATIONS

Hydraulics and Pneumatics, "Swivels and rotating joints", Jan. 1, 2012, Zhu et al., <http://hydraulicspneumatics.com/200/TechZone/FittingsCouplin/Article/False/6421/TechZone-FittingsCouplin>.*

User Manual, Fuji XPC Spray Gun, 20 pages, publish in 2010.

Advertisement of Fuji Spray Gun XPC from 2009, 1 page.

Photograph of Amspray Spray Gun available years before the filing of present application, 1 page.

Brochure of T-Series Spray Gun obtained from trade show in Jul. 2013, 2 pages.

* cited by examiner

*Primary Examiner* — Len Tran
*Assistant Examiner* — Cody Lieuwen
(74) *Attorney, Agent, or Firm* — Hill & Schumacher

(57) ABSTRACT

A paint spray gun for use in association with a HVLP turbine blower and an attachable paint container divides input air flow into two horizontally adjacent channels. Air flow through one channel remains open whereas air flow through the second channel may be varied by a side air controller such that when air flow is cut off from the second channel, the paint mixture is sprayed in a substantially circular shape whereas when air flows through the second channel the paint mixture is sprayed in a substantially fan shape. In another embodiment, a rotatable nipple is positioned to redirect some air flow from the channels to drive paint from the paint container.

15 Claims, 6 Drawing Sheets

SPRAY GUN WITH SIDE-MOUNTED FAN CONTROL

FIELD OF THE DISCLOSURE

The disclosure relates generally to spray guns operated with air supplied by a high-volume, low pressure (HVLP) turbine blower to spray liquids such as paint.

BACKGROUND

Various spray guns are known in the art. Some rely on high pressure air flows, typically in the range of 40-50 pounds per square inch, to atomize and discharge liquids. Others rely on high-volume, low pressure (HVLP) air flows, typically under 10 pounds per square inch.

Various HVLP spray guns rely on standard compressors. Others rely on high-volume, low pressure turbine blowers that are often used in association with paint sprayers. Turbine air flow is constant and can be varied by a turbine motor from approximately 2 to 10 PSI. Turbine motors are preferred as they result in a more efficient atomization of liquids and lower wastage of liquid.

Various HVLP turbine spray guns are known in the art. Some rely on fan size adjustment at the rear. Some rely on fan size adjustment at the front air jet. Others rely on fan size adjustment, side-mounted behind the front barrel.

SUMMARY

An embodiment of the present disclosure describes an apparatus for spraying liquids for use in association with an HVLP blower and a fluid container. The apparatus has an air inlet port which can be connected to the HVLP blower. Air is divided into two horizontally adjacent channels, a variable channel and an open channel, both in flow communication with the air inlet port and both receiving air from the HVLP blower. A side controller is positioned such that the flow of air through the variable channel can be varied whereas the air flow through the open channel remains constant. The spray head is for mixing air from one or both channels as well as fluid from the fluid container.

More specifically, the open channel feeds air into the centre orifice and the variable channel feeds air into two side orifices such that when air is cut off from the variable channel the output fluid mixture has a substantially circular shape and when air flows through the variable channel the output fluid mixture has a substantially fan shape.

In another embodiment, a rotatable nipple extends from one or more of the spray gun's air channels and a second nipple extends from the fluid container such that the nipples are connected by a tube and some air is diverted from the channels to drive fluid from the container to the spray head.

In an alternate embodiment, the fluid container can be located above the spray gun such that gravity in addition to pressure drives the fluid into the spray head.

In another embodiment, a common trigger controls all air flow from the air inlet port such that fluid mixture only exits the spray gun when the trigger is activated.

The air and liquid may be mixed externally of the spray head.

Further features will be described or will become apparent in the course of the following detailed description.

BRIEF DESCRIPTION OF THE DRAWINGS

FIG. 4*b* is a cross sectional view of a portion of an embodiment of the spray gun showing the variable channel when air is allowed to flow through;

The embodiments will now be described by way of example only, with reference to the accompanying drawings, in which:

DETAILED DESCRIPTION

Figure 7:
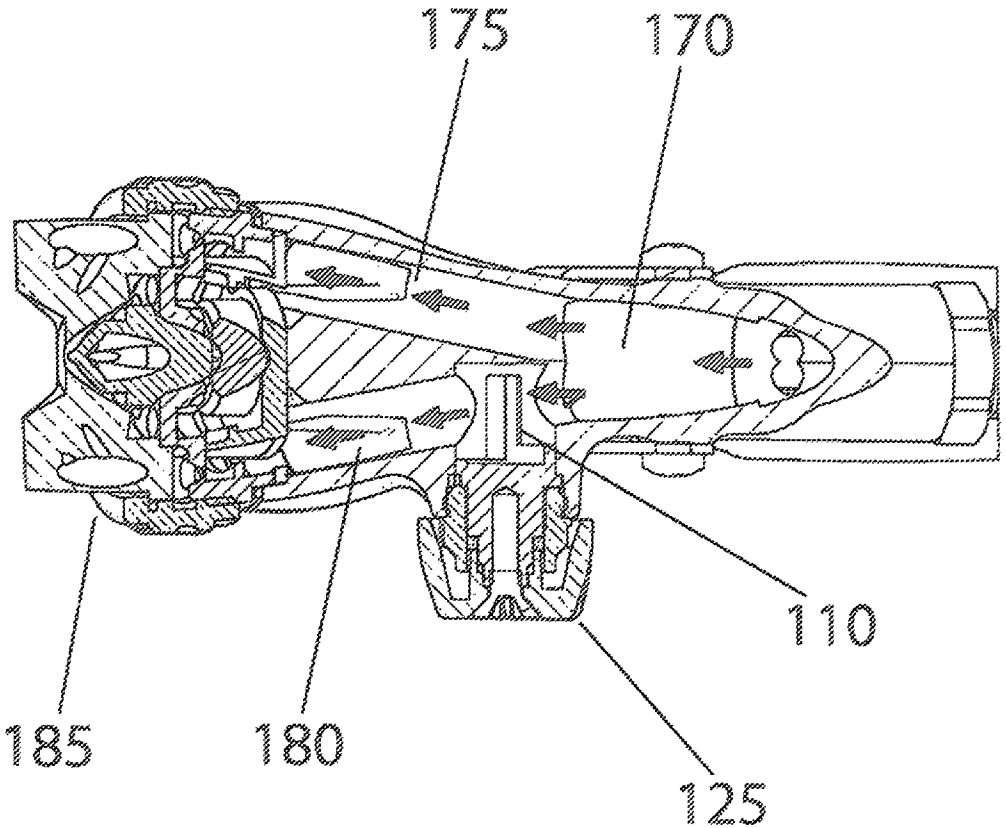
FIG. 7 is a cross sectional view of the horizontally adjacent channels showing the side air controller positioned on the left channel.
Figure 6:
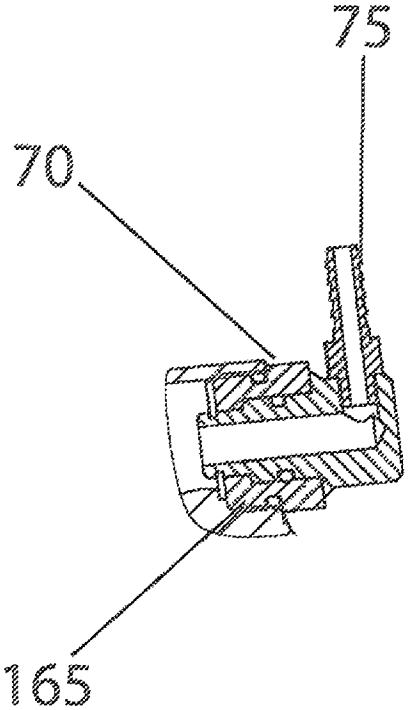
FIG. 6 is a cross sectional view of a portion of an embodiment of the spray gun showing the rotatable nipple.
Figure 8:
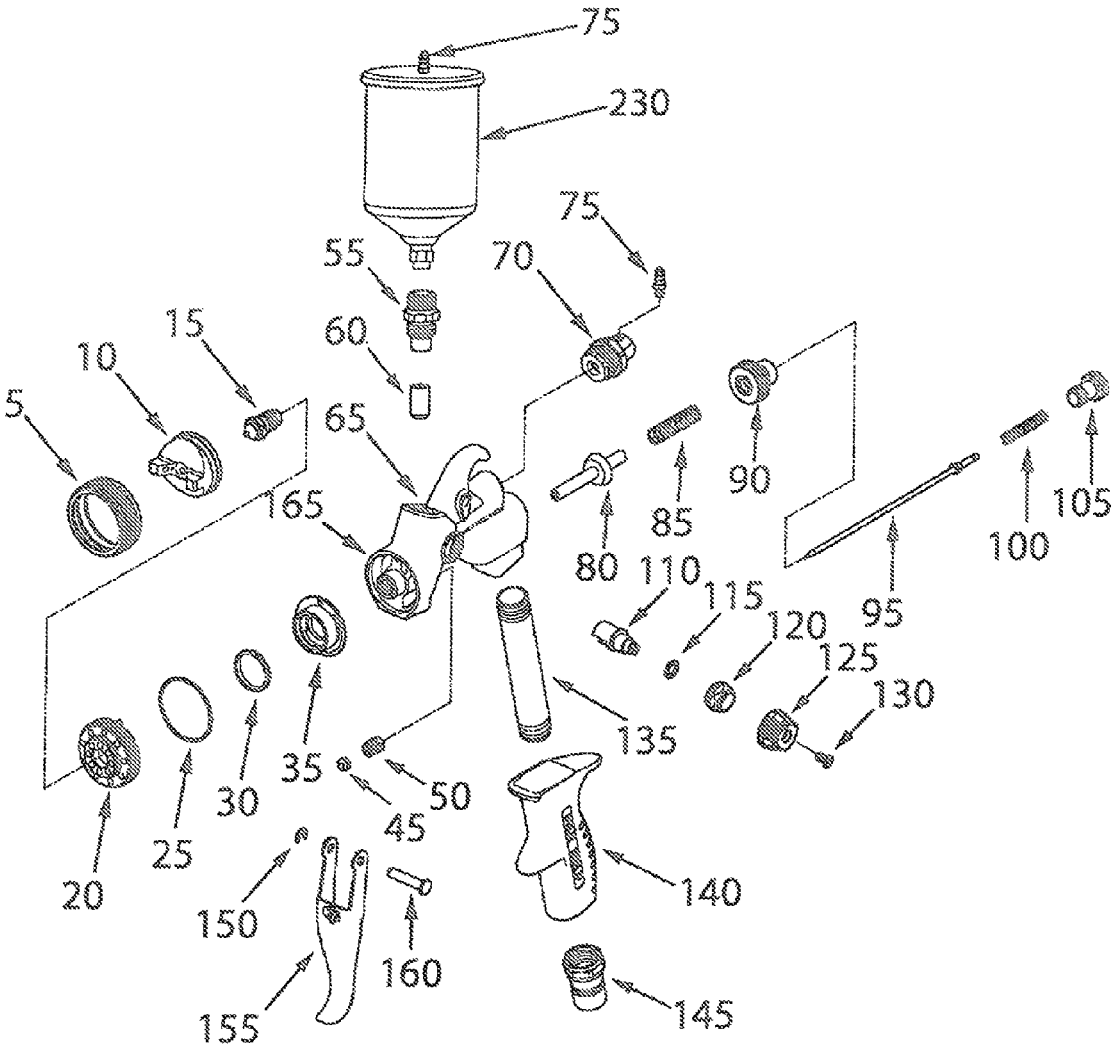
FIG. 8 is a blown apart perspective view of an alternate embodiment of the spray gun showing a top mounted gravity container.

A high volume low pressure manual spray gun that operates from a standard HVLP turbine blower is shown in FIGS. 1 through 8. The spray gun shown in FIGS. 1 through 7 is configured for a bottom mounted liquid container and the spray gun shown in FIG. 8 is configured for a top mounted liquid container 230. The gun has a barrel 165 that supports a spray head 185. A handle tube 135 (shown in FIG. 8) extends downwardly from the barrel 165 and is surrounded by an insulating handle 140. An inlet port 145 is at the bottom of the handle tube 135 and is for receiving compressed air from an HVLP blower such as a turbine blower (not shown). Referring to FIG. 8, a conventional air valve 80 mounted above the handle 140 controls the flow of compressed air through the gun. Valve 80 includes a valve spring 85 and a fluid screw nut 90. A conventional liquid needle valve 95 extends centrally along the interior of the barrel 165 and engages a liquid jet 15 in the spray head 185 to control discharge of liquid. The needle valve 95 includes a liquid valve spring 100 and a fluid adjustment knob 105. The barrel 165 includes a liquid valve seal 45 and a liquid valve seal nut 50.

The spray head 185 has a liquid jet 15 that discharges liquid received from the container and an air jet 10 surrounds the liquid jet 15. The air valve 80 and liquid needle valve 95 are operated with a common trigger 155 in sequence to ensure that paint is not introduced before atomizing air. The air flows within the barrel 165 are directed through passages in the air jet 10 to atomize and spray the discharged liquid.

Trigger 155 is pivotally attached to the barrel with a trigger pin 160 and a retaining ring 150. Trigger 155 is operably connected to air valve 80 and liquid needle valve 95.

Figure 4A:
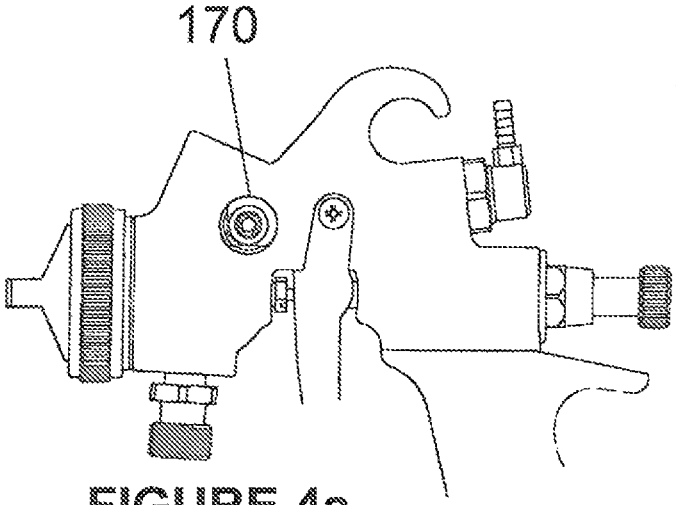
FIG. 4*a* is a side view of an embodiment of the spray gun.
Figure 4B:
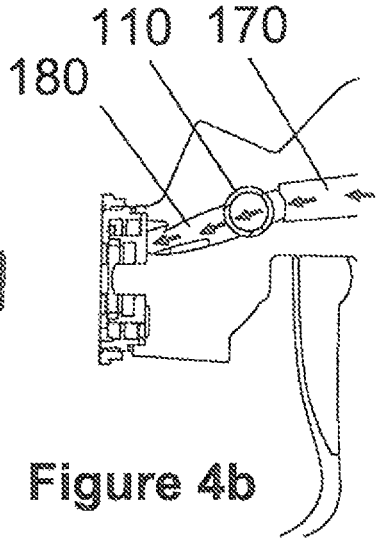
Figure 5A:
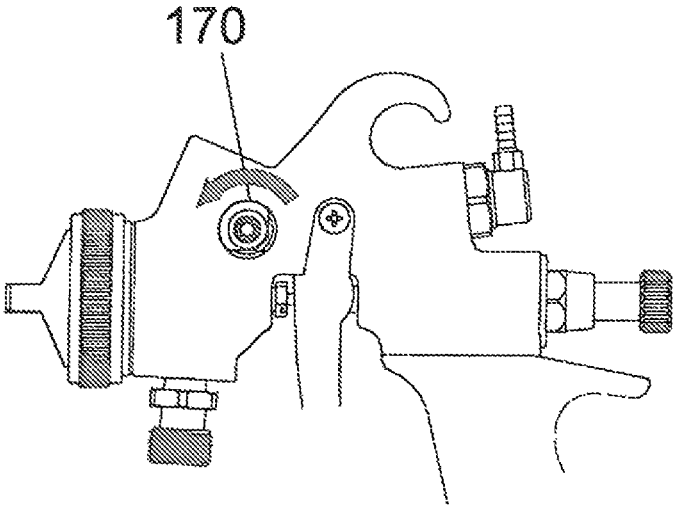
FIG. 5*a* is a side view of an embodiment of the spray gun and showing rotation of the side air controller.
Figure 5B:
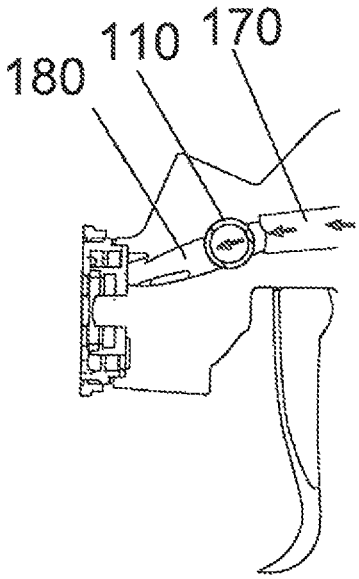
FIG. 5*b* is a cross sectional view of a portion of an embodiment of the spray gun showing the variable channel when air is cut off by the side air controller.

Referring to FIGS. 4, 5, and 7, spray gun has a left or variable air channel 180 and a right or open air channel 175, both of which are in flow communication with the air inlet 145. In use, air flows in through the air inlet 145, through the handle tube 135 and into a main air channel 170. It is then diverted into variable air channel 180 and open air channel 175. It then flows into the spray head 185. A side-mounted fan pattern control knob 125 controls a side air controller 110 to limit air through the left air channel or variable air channel 180 in the barrel 165. The side air controller 110 is rotatably mounted in the barrel 165. A control knob nut 120 is connected to an air deflector seal 115 and secures the controller 110 to the barrel 165. The side-mounted fan pattern control knob 125 is connected to the controller 110 with a locking screw 130.

Referring to FIG. 8, an air divider 35 disperses air through an air diffuser 20 to the air jet 10 to increase or decrease the size of the fan pattern of the atomized liquid discharge. When air flows through both air channels 175, 180 in the front of barrel 165 the air flows through the side holes and center hole of the air jet 10 producing a large size fan pattern shape. When air is cut off to the left air channel or variable air channel 180, air flows only through the right air channel 175 to the center orifice of the air jet 10 producing a circular pattern.

As shown in FIG. 8, the spray head 185 includes a collar 5, an air jet 10, a liquid jet 15, and air diffuser 20, a diffuser seal 25, an air divider seal 30 and an air divider 35.

Figure 1:
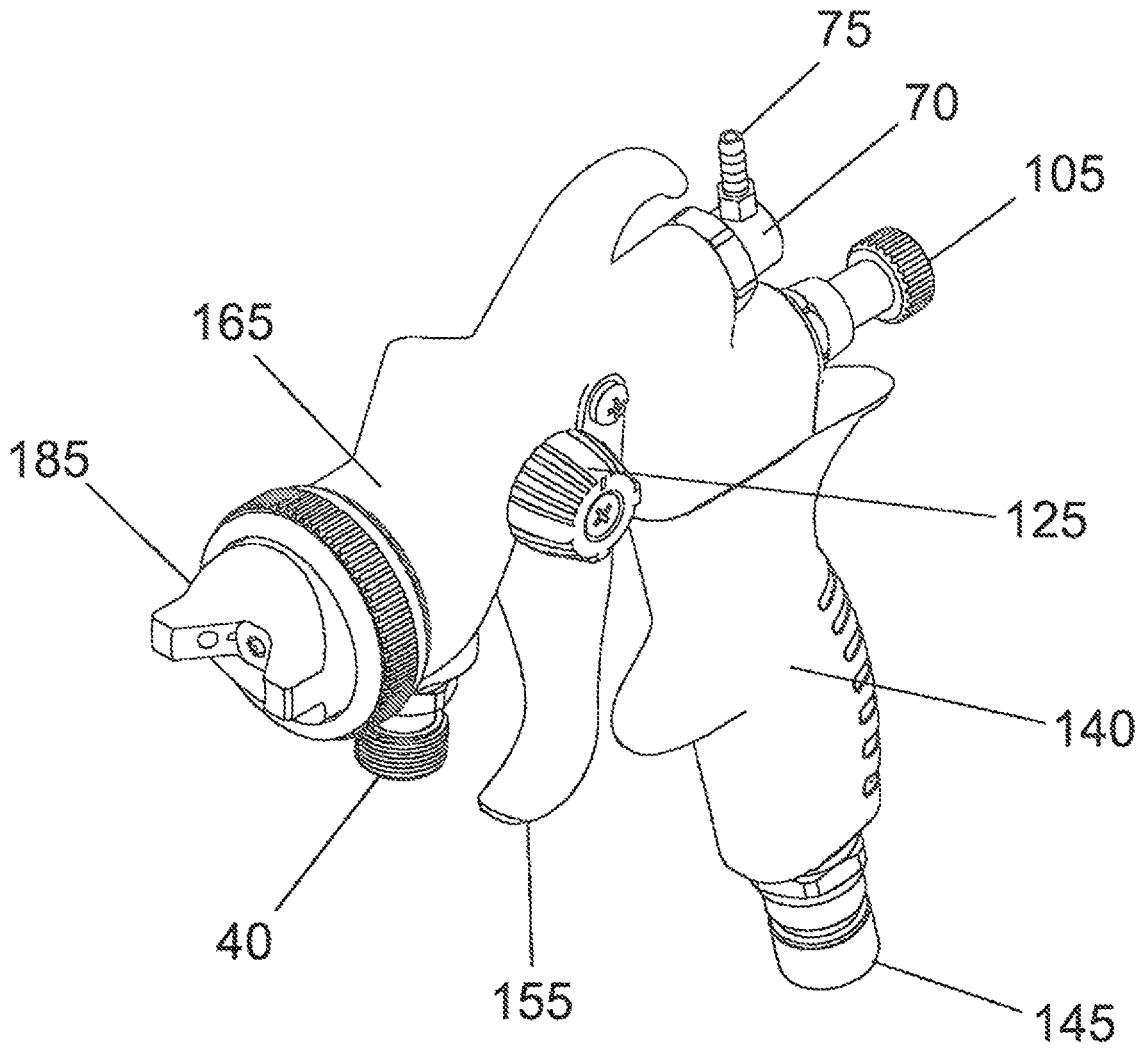
FIG. 1 is a perspective view of the left profile of an embodiment of the spray gun.
Figure 2:
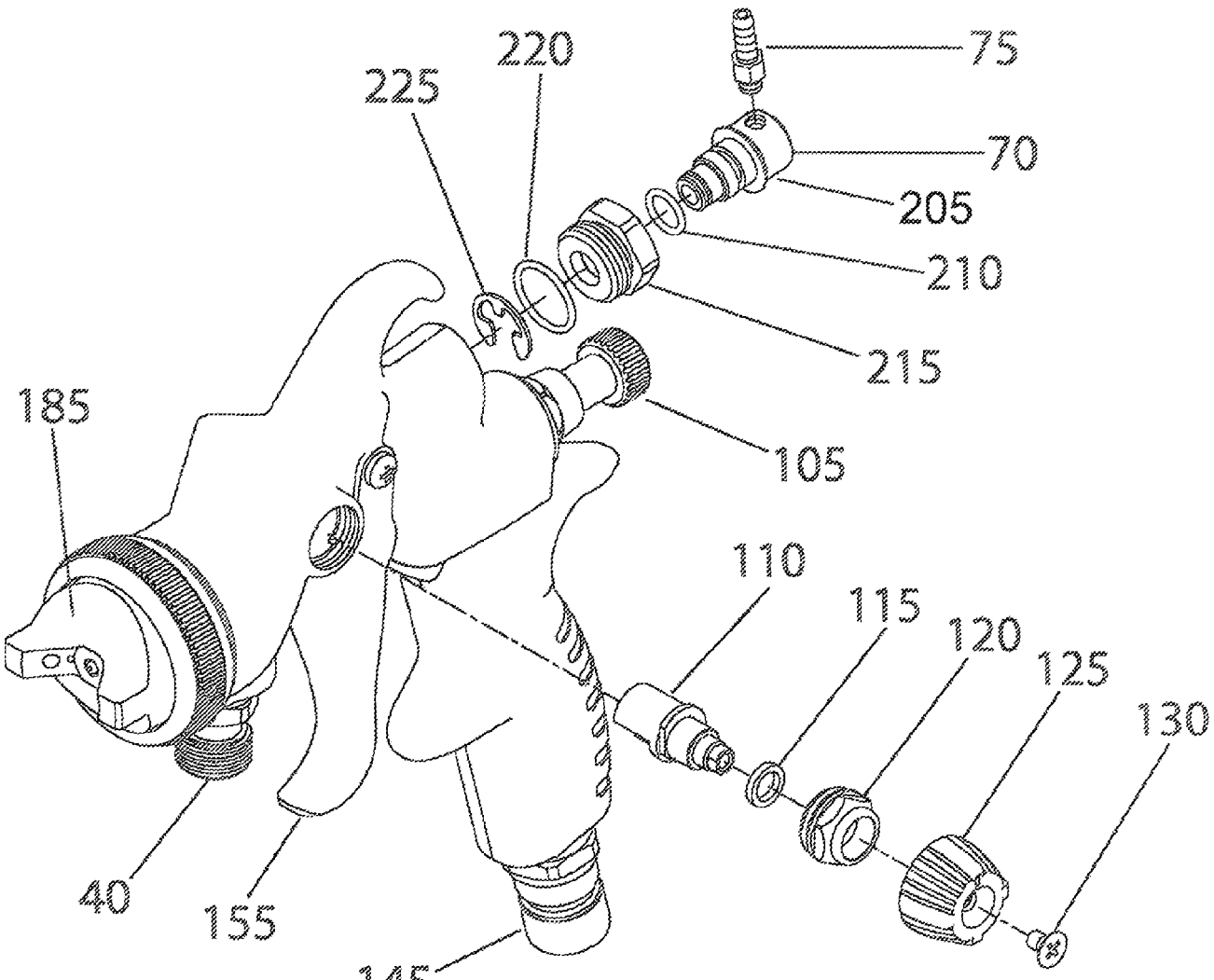
FIG. 2 is an exploded perspective view of the left profile of an embodiment of the spray gun and showing the components of the side air controller and the rotatable nipple.
Figure 3:
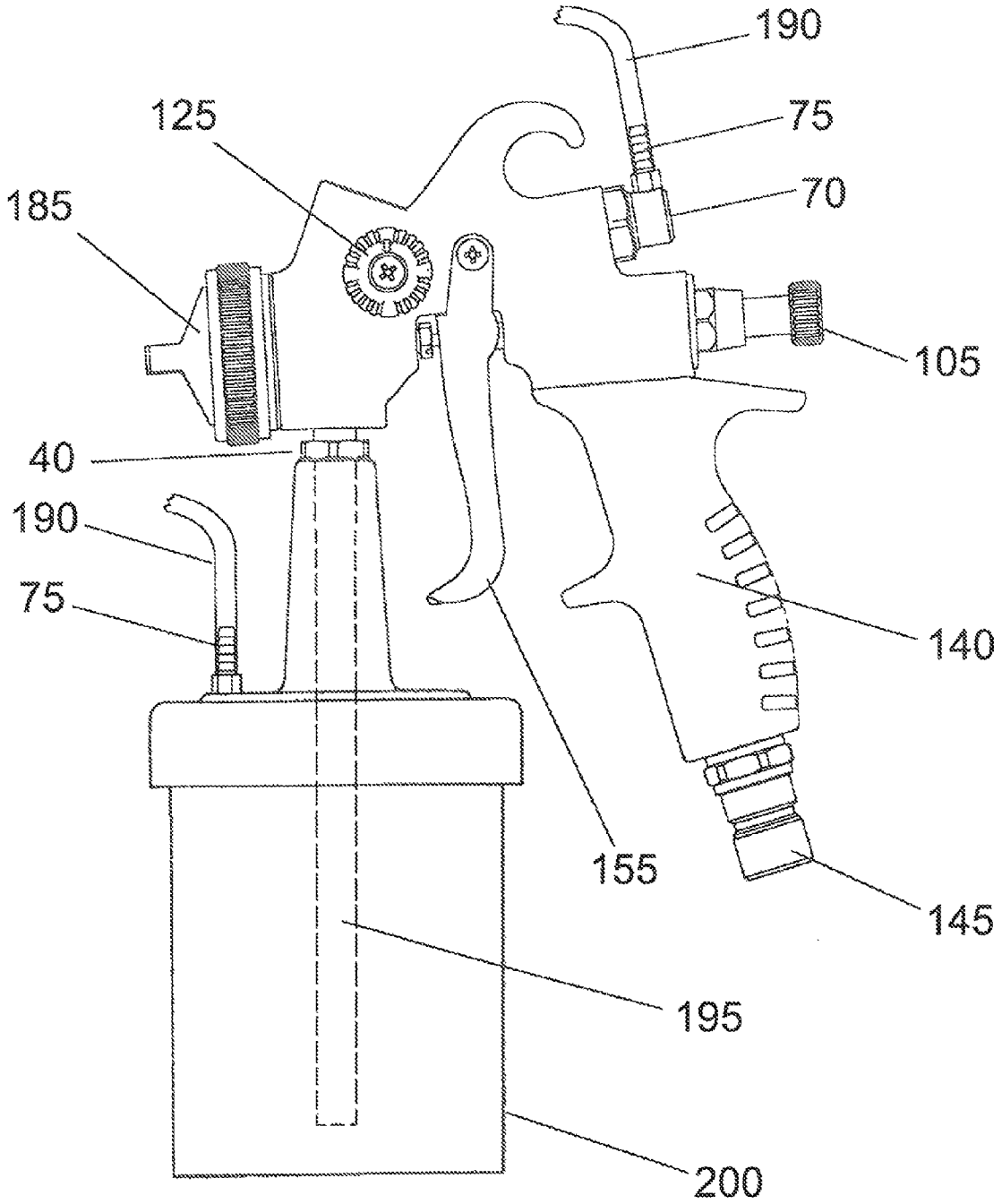
FIG. 3 is a side view of the left profile of an embodiment of the spray gun with an attached fluid container.

As shown in FIG. 3, part of the air flow in the spray gun is diverted into a liquid container 200 attached below the spray gun to force liquid into the spray head 185. Note if the top mounted liquid container 230 is attached so that it is above the barrel 165, as shown in FIG. 8, gravity plus pressurized air from the flexible tube 190 will feed the liquid into the spray gun. A rotatable nipple assembly 70 at the rear of the barrel 165 supplies pressurizing air to the container 200 through a flexible tube 190 attached to another nipple 75 on container 200. The rotatable nipple assembly 70 allows the operator to set the direction of nipple to his preference to accommodate the container 200 or top mounted container 230. At the spray head 185, air from the variable air channel 180 and from the open air channel 175 is mixed with fluid from the fluid container 200 to produce a fluid mixture which is then ejected from the spray head. In the embodiment shown herein the air and the fluid is mixed externally of the spray head 185.

The rotatable nipple assembly 70 includes a nipple 75, a rotatable portion 205, a small seal 210, a nipple assembly nut 215, a large seal 220 and a retaining ring 225. The rotatable nipple assembly 70 allows the flexible tube 190 (shown in part in FIG. 3) to be connected to the container 200. The flexible tube 190 can rotate so that air can freely flow through flexible tube 190. The container 200 is connected to the barrel 165 through the fluid coupler 40.

To control the size of the fan pattern by turning a knob requires the pressurized air to pass from a main air channel 170 through to the right air channel or open air channel 175 and left air channel or variable 180 that are separate and distinct. The left air channel 180 airflow is controlled by a side air controller 110. The right air channel 175 is always fully open for constant airflow. These passages reside in the main barrel 165 behind the spray head 185. Airflow through the right air channel 175 is diverted by the air divider 35 through to the air diffuser 20 so that air flows only through the center hole of the air jet 10. Airflow through the left channel is controlled by a rotating side air controller 110 allowing varying levels of airflow through to the spray head 185. The air flow from the left air channel 180 is diverted by the air divider 35 and through the air diffuser 20 so that air flow can only pass through the side holes of the air jet 10.

When air is passed through both air channels the atomized liquid is discharged in a wide 'fan' pattern. When air is completely cut off by the side air controller 110 in the left air channel 180, the atomized liquid is discharged in a small round circular pattern. By turning the fan control knob 125 to restrict and vary air volume through the spray head 185, a full incremental range of fan sized patterns can be produced.

Unlike other HVLP turbine spray guns with side mounted fan control, the barrel 165 is split down the middle forming two natural horizontal air channels set side by side. This method allows for both right 175 and left air channels 180 to have a much greater cross sectional area, as compared to spray guns where the channels are an upper and lower channel, resulting in greater airflow through the spray head 185. The left air channel 180 is fitted with a rotating side air controller 110 to reduce or shut off the air flow thereby adjusting the size of the fan of the atomized liquid discharge.

A unique rotatable nipple assembly 70 placed in a unique location at the rear of the barrel 165 supplies pressurizing air to the container through a flexible tube 190 attached to the nipple 75. The flexible tube 190 connects nipple 75, which is part of the rotatable nipple assembly 70, to the other nipple 75 attached to the liquid container 200. A liquid tube 195 extends into the liquid container 200. Pressurized air from flexible tube 190 is connected to the liquid container 200 so that liquid container 200 is pressurized and liquid is forced into the spray gun when the trigger 155 is activated.

Several advantages are achieved over the prior art, particularly HVLP turbine spray guns with side mounted fan pattern control. Placing the two air channels side by side allows for a greater volume of airflow through the spray head 185 reducing back pressure and air turbulence in the gun barrel 165 and through the spray head 185. Placing the two air passages side by side streamlines the linear air flow producing superior atomization. Use of a simpler, shorter side air controller 110 reduces the incidence of jamming and the need for periodic adjustment.

An alternate embodiment is shown in FIG. 8 wherein the barrel 165 is provided with a top liquid inlet. Inlet 65 has a fluid coupler 55 and a fluid coupler seal 60. In this embodiment a top mounted liquid container 230 may be attached to the top liquid port 65 and the liquid may be gravity fed into the spray gun.

As used herein, the terms, "comprises" and "comprising" are to be construed as being inclusive and open ended, and not exclusive. Specifically, when used in the specification and claims, the terms, "comprises" and "comprising" and variations thereof mean the specified features, steps or components are included. These terms are not to be interpreted to exclude the presence of other features, steps or components.

As used herein, the term "exemplary" means "serving as an example, instance, or illustration," and should not be construed as preferred or advantageous over other configurations disclosed herein.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

Unless defined otherwise, all technical and scientific terms used herein are intended to have the same meaning as commonly understood to one of ordinary skill in the art.

What is claimed is:

1. An apparatus for spraying liquids comprising:

a barrel having a front end having a spray head, a rear end, and a pair of side walls extending horizontally between the front end and the rear end, each side wall defining one of a left side wall and a right side wall;

an air inlet port connectable to an HVLP turbine blower;

a variable channel in flow communication with the air inlet port;

an open channel in flow communication with, and remaining open to the air inlet port, the variable channel and the open channel extending generally horizontally side by side with respect to each other in the barrel wherein one of the channels extends adjacent to the right side wall, and the other channel extends adjacent to the left side wall; and a side air controller mounted on one of the right side wall and the left side wall and operably connected to and located within only the variable channel and rotatably mounted generally orthogonally to a side of the variable channel such that the flow of air through the variable channel is varied by the side air controller, whereas air flow through the open channel remains constant; and the spray head at the front end of the barrel mixing air, received from the variable and open channels, and fluid.

2. The apparatus as claimed in claim 1, further including a trigger that controls the air flow through both the open channel and the variable channel and the fluid from the fluid container such that the trigger controls all fluid flow.

3. The apparatus as claimed in claim 2, wherein the open channel is connected to a central orifice in the spray head such that the fluid mixture ejected from the spray head has a substantially circular shape.

4. The apparatus as claimed in claim 3, wherein the variable channel is connected to side holes in the spray head such that when the variable channel is open, the fluid mixture ejected from the spray head has a substantially fan shape.

5. The apparatus as claimed in claim 1, wherein the fluid container is located below the apparatus.

6. The apparatus as claimed in claim 1, wherein the fluid container is located above the apparatus and gravity is used as an assist to drive fluid from the fluid container to the spray head.

7. The apparatus as claimed in claim 1, wherein the fluid is paint.

8. The apparatus as claimed in claim 1, further including a main channel in flow communication with, and located between the air inlet port on one end and the open channel and the variable channel on other end, and further including a nipple in flow communication with the air inlet port and extending from the main channel, and a flexible tube connected to the fluid container such that air from the HVLP blower is used to drive fluid into the spray head.

9. The apparatus as claimed in claim 8, where the nipple is a rotatable nipple.

10. The apparatus as claimed in claim 1, where the air and the fluid are mixed externally of the spray head.

11. An apparatus for spraying liquids comprising, an HVLP turbine blower;

a barrel having:

a front end having a spraying head, a rear end, and a pair of side walls extending horizontally between the front end and the rear end, each side wall defining one of a left side wall and a right side wall;

an air inlet port connectable to the HVLP turbine blower;

a variable air channel, in flow communication with the air inlet port;

an open channel in flow communication with, and remaining open to the air inlet port, the variable channel and the open channel extending generally horizontally side by side with respect to each other in the barrel wherein one of the channels extends adjacent to the right side wall, and the other channel extends adjacent to the left side wall;

a side air controller mounted on one of the right side wall and the left side wall and operably connected to and located within only the variable channel and rotatably mounted generally orthogonally to the side of the variable channel such that the flow of air through the variable channel is varied by the side air controller, whereas air flow through the open channel remains constant;

a fluid container for containing fluid;

the spray head at the front end of the barrel mixing air, received from the air channels, and fluid, received from the fluid container; and a rotatable nipple extending from the air channel, the rotatable nipple being connectable to a tube such that a portion of air blown through the air channel is diverted through the tube to a nipple extending from the fluid container to drive fluid from the fluid container to the spray head.

12. The apparatus as claimed in claim 11, wherein the nipple extending from the fluid container is also a rotatable nipple.

13. The apparatus as claimed in claim 11, further including a trigger that controls the air flow and the fluid from the fluid container such that the trigger controls all fluid flow.

14. The apparatus as claimed in claim 11, wherein the fluid is paint.

15. The apparatus as claimed in claim 11, where the air and the fluid are mixed externally of the spray head.

* * * * *